US009289904B2

(12) United States Patent
Hawk et al.

(10) Patent No.: US 9,289,904 B2
(45) Date of Patent: Mar. 22, 2016

(54) LOCK OPTIONAL, SPRING ASSISTED FOLDING KNIFE

(71) Applicants: Grant Woodrow Hawk, Idaho City, ID (US); Gavin Dan Hawk, Idaho City, ID (US)

(72) Inventors: Grant Woodrow Hawk, Idaho City, ID (US); Gavin Dan Hawk, Idaho City, ID (US)

( * ) Notice: Subject to any disclaimer, the term of this patent is extended or adjusted under 35 U.S.C. 154(b) by 358 days.

(21) Appl. No.: 13/674,846

(22) Filed: Nov. 12, 2012

(65) Prior Publication Data

US 2013/0212886 A1 Aug. 22, 2013

(51) Int. Cl.
*B26B 1/00* (2006.01)
*B26B 1/04* (2006.01)
*B26B 1/02* (2006.01)

(52) U.S. Cl.
CPC .... *B26B 1/04* (2013.01); *B26B 1/02* (2013.01)

(58) Field of Classification Search
CPC ..... B26B 1/02; B26B 1/04
USPC ..... 30/161, 160, 155, 158, 159
See application file for complete search history.

(56) References Cited

U.S. PATENT DOCUMENTS 338,853 A * 3/1886 Marks ..... 30/143
412,799 A * 10/1889 Schenck ..... 30/158
2,416,277 A * 2/1947 Siegel ..... 30/158
4,769,912 A * 9/1988 Davis ..... 30/162
5,203,085 A * 4/1993 Berns ..... 30/163
5,349,753 A * 9/1994 Gaffney ..... 30/155
5,815,927 A * 10/1998 Collins ..... 30/161
7,080,457 B2 * 7/2006 Sullivan ..... 30/160
7,124,509 B1 * 10/2006 Hawk ..... 30/160
7,246,441 B1 * 7/2007 Collins ..... 30/160
7,681,316 B2 * 3/2010 Hawk et al. ..... 30/160
7,854,067 B2 * 12/2010 Lake ..... 30/159
7,905,022 B2 * 3/2011 Hawk et al. ..... 30/158
8,109,002 B2 * 2/2012 Frazer ..... 30/123
8,296,958 B1 * 10/2012 Frazer ..... 30/161
8,511,208 B1 * 8/2013 Frazer ..... 81/427.5
8,584,367 B2 * 11/2013 Chu et al. ..... 30/151
2006/0272158 A1 * 12/2006 Williams ..... 30/161
2007/0124940 A1 * 6/2007 Hawk et al. ..... 30/161
2007/0130778 A1 * 6/2007 Ruggiero ..... 30/161
2007/0169355 A1 * 7/2007 Lake ..... 30/160
2008/0307656 A1 * 12/2008 Lin ..... 30/159
2009/0288301 A1 * 11/2009 Hawk et al. ..... 30/161
2010/0132198 A1 * 6/2010 Hawk et al. ..... 30/161
2011/0010947 A1 * 1/2011 Freeman ..... 30/159
2014/0115899 A1 * 5/2014 Frazer ..... 30/160

* cited by examiner

*Primary Examiner* — Omar Flores Sanchez
(74) *Attorney, Agent, or Firm* — Parsons Behle & Latimer

(57) ABSTRACT

A folding knife, whereby a unique arrangement of linked levers, produces a geometry of mechanical advantage, allowing the user to safely deploy an extended, but unlocked blade, by simply griping the handle. A resilient element, in conjunction with the linked levers, produces a powered assist in the act of opening the blade and also in the act of closing the blade. Alternately, further means are disclosed of providing the option of a positive locking blade.

10 Claims, 3 Drawing Sheets

LOCK OPTIONAL, SPRING ASSISTED FOLDING KNIFE

BACKGROUND

Historically, folding knives have fallen into two distinct categories, generally referred to as friction folders of the first category, or locking folders of the second category. Friction folders are typically configured in such a way as to provide a detent in both the open and closed position. The act of opening or closing such a knife often requires the user to deploy both hands in order to overcome a detent of varying degrees of resistance, while locking folders typically lock automatically upon opening. The two main options have been, that of either designing a knife more prone to the dangers of accidental closing, or that of designing a knife that requires delocking before closing, but somewhat less likely to close unintentionally. The compromise inherent in friction folding knife design, led to the development of locking folders that must be manually delocked before closing. These locking folding knives solved most of the safety considerations but introduced further complications of mechanical complexity, and in many cases, new safety considerations arising from the act of delocking, as in the case of the so called liner-locks which require the thumb to cross the path of the closing blade. The inconvenience introduced by the necessity to delock is often seen as a further disadvantage of current locking designs.

OBJECTIVE

The objective therefore, of the current invention is to provide for a folding knife, of a non-locking design, that overcomes the safety disadvantages of the prior art. Further advantages include ease of manufacture, by virtue of fewer and simpler parts, and a unique mechanism that allows quick and easy manipulation through both the opening and closing cycles.

| Reference Numbers | |
|---|---|
| 10 Blade | 12 Handle Frame |
| 14 Resilient Member | 16 Blade Pivot Pin |
| 18 Stop Pin | 20 Flipper Spur |
| 22 Handle Overlay | 24 Traveling Link |
| 26 Traveling Link Pivot | 28 Frame Spacer |
| 30 Traveling Link Detent Open | 32 Traveling Link Detent Closed |
| 34 Detent Roller | 36 Detent Roller Axis Pin |
| 38 Detent Roller Pocket | 40 Resilient Member Fixed Anchor |
| 42 Resilient Member Traveling Anchor | 44 Frame Spacer Screws |

DRAWING FIGURES

Figure 1:
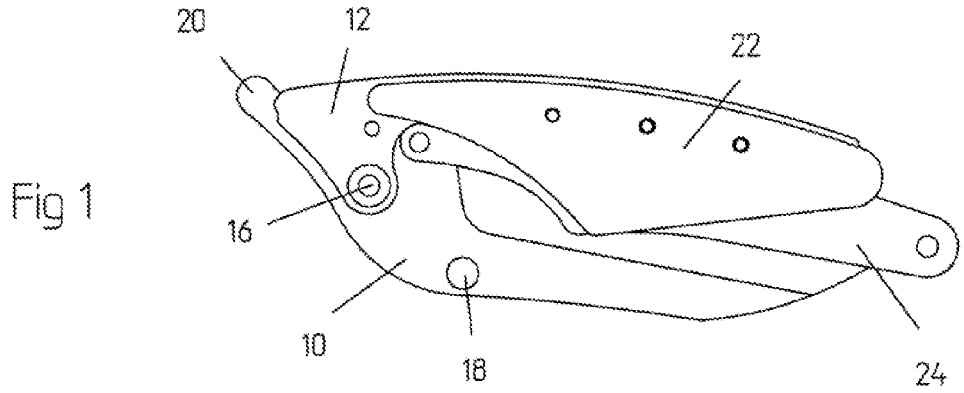
Figure 2:
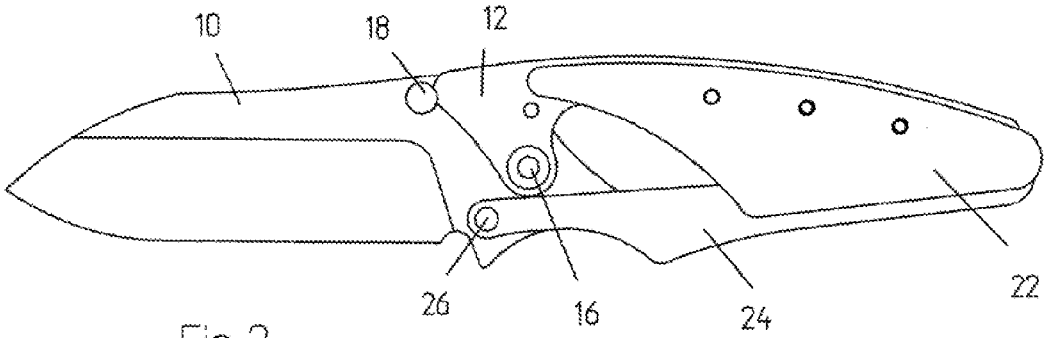
Figure 3:
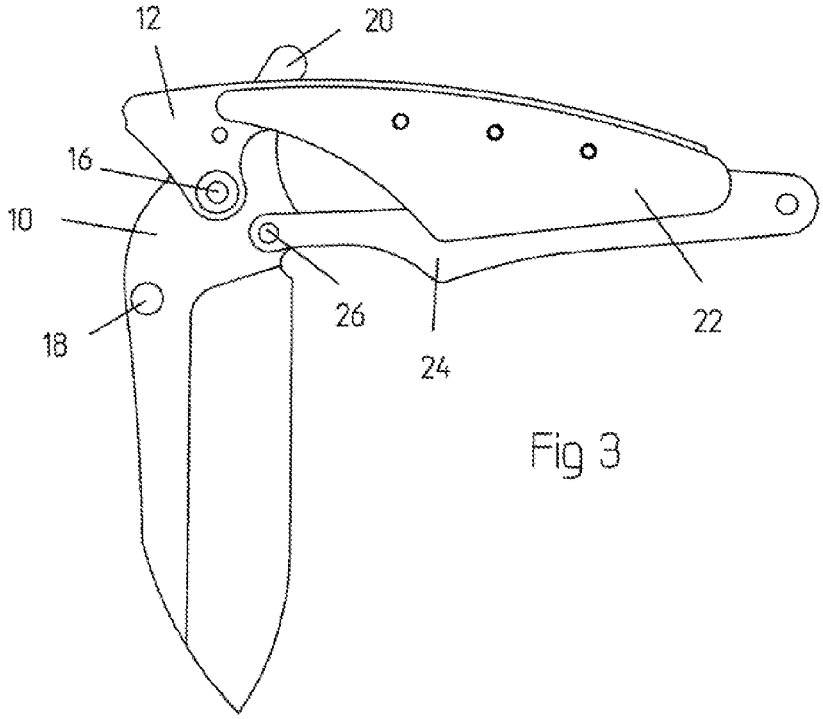

Drawing Sheet 1/3 shows the knife in the three stages of opening and closing, FIG. 1 shows the knife in closed position, FIG. 2 shows the same knife in the open position and FIG. 3 shows the knife at the half open position.

Figure 4:
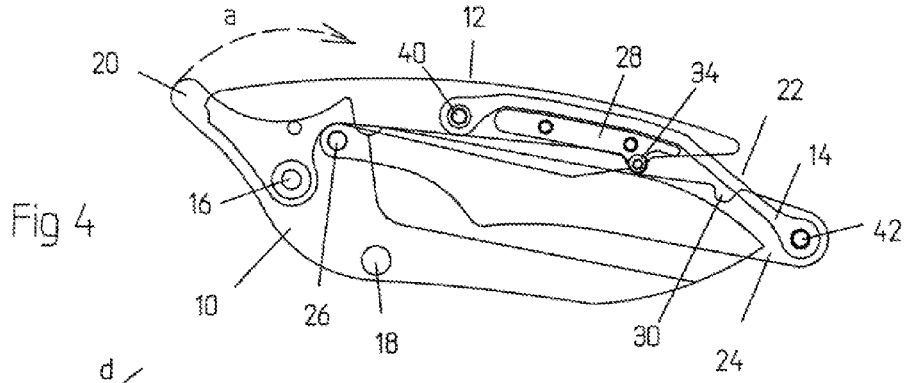
Figure 5:
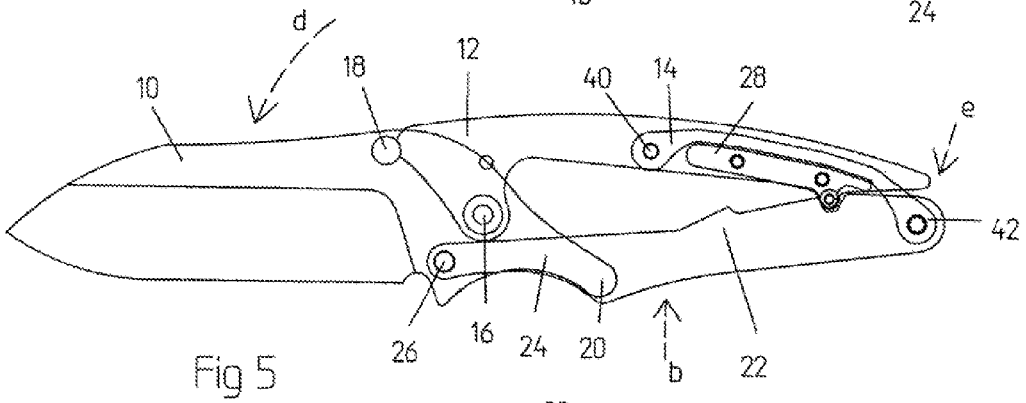
Figure 6:
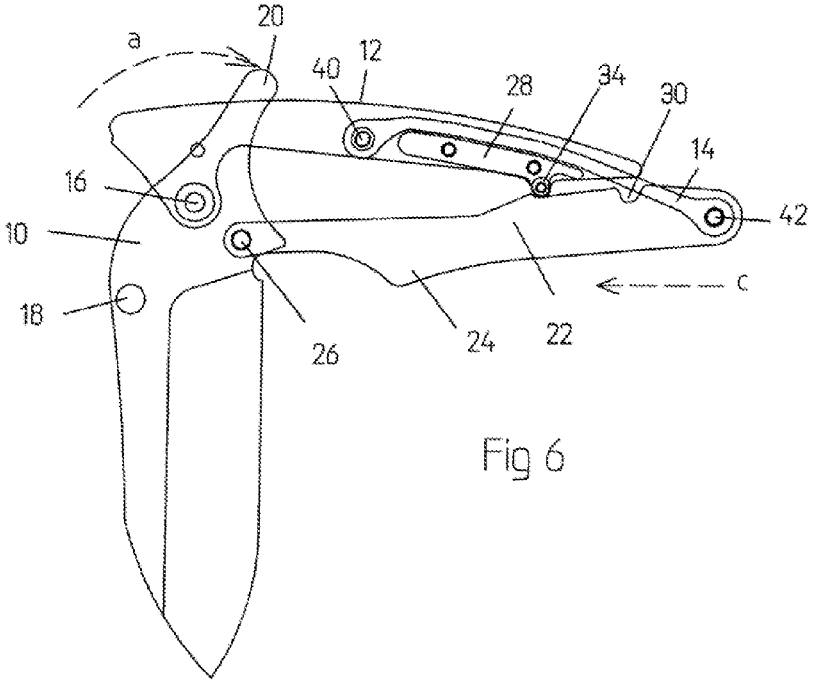

Drawing Sheet 2/3 shows the knife in the three stages of opening and closing with all the parts shown in transparent view to illustrate their interaction. FIG. 4 shows the knife in closed position, FIG. 5 shows the knife in open position, and FIG. 6 shows the knife in mid travel between open and closed.

Figure 7:
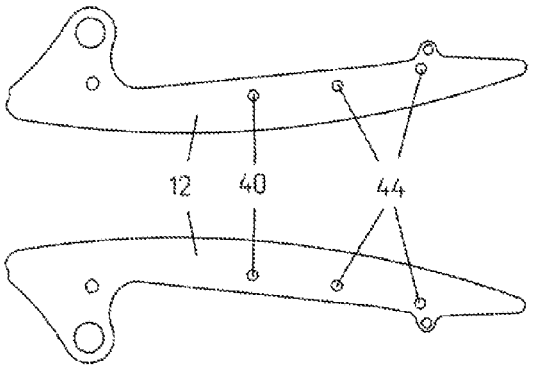
Figure 8:
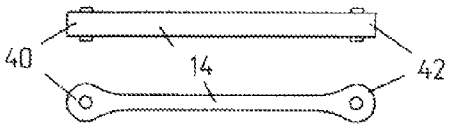
Figure 9:
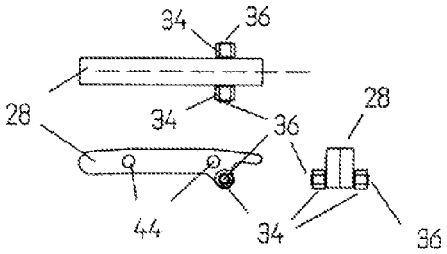
Figure 10:
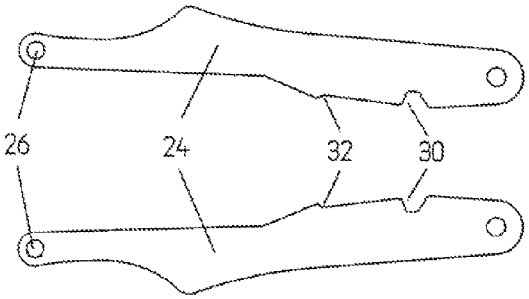

Drawing Sheet 3/3, FIG. 7 shows a side view of handle frames front and back. FIG. 8 shows top and side view of resilient member, FIG. 9 shows top, side, and end view of frame spacer with rollers and pins, FIG. 10 shows a side view of traveling links and the portion of traveling links that serves as an open detent and closed detent.

IN OPERATION

Referring to FIG. 4 of sheet 2/3 the opening cycle is initiated by pressing on trigger spur 20, in the direction of arrow a. As Trigger spur 20 is made to rotate about blade pivot pin 16, traveling link 24 is forced rearward, extending resilient member 14, until reaching a point slightly past equilibrium, as shown in FIG. 6. At this point in the travel of blade 10 towards open, the resilient member 14, powers traveling link 24 in the direction of arrow c, causing blade 10 to complete it's travel to full open position as in FIG. 5.

When the blade is in the full open position of FIG. 5, the blade is not locked, but the mere act of gripping the handle, which applies pressure in the direction of arrow b is sufficient to safely hold the blade in position for most practical purposes, by virtue of the engagement of detent roller 34 with traveling link detent 30.

Closing of blade 10 is accomplished by simply exerting pressure on blade 10 in the direction of arrow d while holding handle frame 12 stationary. As blade 10 moves toward closing, the detent notch 30 of FIG. 11, sheet 3/3, is forced out of engagement with detent roller 36, as shown at FIG. 10. Allowing the blade 10 to return to the closed position.

In order to reconfigure the non locking design (as shown) to that of a locking design (not shown), it is only necessary to alter the angle of the interface of detent 30 to prevent the escape of traveling link 24 from roller 36. When the design is a lock open configuration, the delocking cycle must be preceded by finger pressure applied to traveling link 24 at a point, and in a direction, as indicated by arrow e of FIG. 5.

IN CONCLUSION

As can be readily understood by a careful analysis of the foregoing the "lock optional, spring assist, folding knife" of the current invention offers substantial improvements for a folding knife. For example, even though the handle to blade interface may be non-locking, the configuration is such that the mere act of griping the handle insures that the blade will not accidentally close, resulting in injury to the operator. Furthermore it is clearly apparent that the greatly simplified means of providing for a spring assisted opening blade and the strong and easily manufactured parts, by which that objective is achieved, holds great advantage over that of the prior art.

What is claimed is:

1. A knife comprising:

a blade;

a handle element having a first end and a second end; the first end of the handle element being pivotably coupled to the blade at a first fixed pivot axis to permit the blade to rotate between a closed position and an open position;

a single traveling link having a first end and a second end, the first end of the single traveling link being pivotably coupled to the blade at a second fixed pivot axis; and a resilient member being connected to the second end of the traveling link and being connected to a portion of the handle element, wherein the resilient member limits the movement of the traveling link along a predetermined path between a first position when the blade is in the open position and a second position when the blade is in the closed position.

2. The knife of claim 1, the traveling link further comprising a first detent and a second detent and the handle further comprising a protrusion, wherein the protrusion engages the first detent when the blade is in the open position selectively locking the blade in the open position and the protrusion engages the second detent when the blade is in the closed position.

3. The knife of claim 2, wherein in the open position the traveling link is exposed to provide a gripping surface for a user.

4. The knife of claim 3, wherein the protrusion is a free turning roller.

5. The knife of claim 4, the blade further comprising a cutting surface at a first end and a protrusion at a second end, wherein the protrusion extends beyond the handle element when the blade is in the closed position.

6. A knife comprising:

a blade, the blade having a first planar surface and a second planar surface;

a handle element having a first end and a second end; the first end of the handle element being pivotably coupled to the blade at a first fixed pivot axis to permit the blade to rotate between a closed position and an open position;

a first traveling link having a first end and a second end, the first end of the first traveling link being pivotably coupled to the first planar surface of the blade at a second fixed pivot axis;

a second traveling link having a first end and a second end, the first end of the second traveling link being pivotably coupled to the second planar surface of the blade at the second fixed pivot axis; and a resilient member having a first end and a second end, the first end of the resilient member being connected to both the second end of the first traveling link and the second end of the second traveling link, the second end of the resilient member being connected to a portion of the handle element, wherein the resilient member limits the movement of the first and second traveling links along a predetermined path between a first position when the blade is in a open position and a second position when the blade is in a closed position.

7. The knife of claim 6, wherein the second end of the first traveling link and the second end of the second traveling link both first move laterally away from the first end of the handle as the blade is rotated from the opened position to the closed position.

8. The knife of claim 1, wherein when the blade is the open position the first fixed pivot axis is positioned between the second fixed pivot axis and the second end of the handle element and wherein when the blade is in the closed position the second fixed pivot axis is positioned between the first fixed pivot axis and the second end of the handle element.

9. The knife of claim 1, wherein the blade is adapted to be held in the open position by gripping the handle element to apply pressure to the single traveling link.

10. A knife comprising:

a blade;

a handle element having a first end and a second end; the first end of the handle element being pivotably coupled to the blade at a first fixed pivot axis to permit the blade to rotate between a closed position and an open position;

a single traveling link having a first end and a second end, the first end of the single traveling link being pivotably coupled to the blade at a second fixed pivot axis; and a resilient member being connected to the second end of the traveling link and being connected to a portion of the handle element, wherein the resilient member limits the movement of the traveling link along a predetermined path between a first position when the blade is in the open position and a second position when the blade is in the closed position and wherein when the blade is the open position the first fixed pivot axis is positioned between the second fixed pivot axis and the second end of the handle element and wherein when the blade is in the closed position the second fixed pivot axis is positioned between the first fixed pivot axis and the second end of the handle element, wherein in the open position the traveling link is exposed to provide a gripping surface for a user, and wherein the blade is adapted to be held in the open position by gripping the handle element to apply pressure to the single traveling link.

* * * * *